US006931735B1

(12) United States Patent
Clark et al.

(10) Patent No.: US 6,931,735 B1
(45) Date of Patent: Aug. 23, 2005

(54) WINDOW TREATMENT HANGING TOOL

(76) Inventors: John F. Clark, 1756 Chestwood Dr., Virginia Beach, VA (US) 23453; Wayne St. Aubyn, 463 Lance Ct., Millville, NJ (US) 08332

( * ) Notice: Subject to any disclaimer, the term of this patent is extended or adjusted under 35 U.S.C. 154(b) by 0 days.

(21) Appl. No.: 10/814,997

(22) Filed: Mar. 31, 2004

(51) Int. Cl.[7] ..... E01C 21/00; G01C 9/00
(52) U.S. Cl. ..... 33/194; 33/427
(58) Field of Search ..... 33/194, 427, 451, 33/452, 464, 474, 476, 481

(56) References Cited

U.S. PATENT DOCUMENTS 164,008 A * 6/1875 Kirkpatrick ..... 33/427
3,120,058 A * 2/1964 Walton ..... 33/427
4,910,876 A * 3/1990 Channell ..... 33/194
5,131,164 A * 7/1992 Miller ..... 33/427
5,551,160 A * 9/1996 Ferris et al. ..... 33/452
6,442,853 B1 * 9/2002 Hale et al. ..... 33/194

* cited by examiner

*Primary Examiner*—Christopher W. Fulton
(74) *Attorney, Agent, or Firm*—Stuart M. Goldstein

(57) ABSTRACT

A window treatment hanging tool is made up of two right angled shaped guide components. The first guide component has dual arms positioned perpendicular to each other, each with channeled pathways. The second guide component also has dual arms in perpendicular relation to each other, each arm having an elongated member which is adapted to be slideably and adjustably insertable within the pathways of the first guide component. Each guide component also has measurement markings. Properly positioning the guide components on or within windows or window frames allows proper alignment and lateral equidistance positioning of a window hanging treatment support in relation to the window or window frame.

31 Claims, 5 Drawing Sheets

WINDOW TREATMENT HANGING TOOL

BACKGROUND OF THE INVENTION

The installation of window treatments requires the use of window treatment hanging supports such as curtain and valance rods and brackets, vertical and horizontal Venetian blind supports, and the like. However, positioning such supports for attachment to wall surfaces, such that the window treatments are properly aligned in relation to the window has always been problematic. Anyone who has attempted to hang a curtain rod, so that it is properly aligned in relation to a window, with its ends equidistance from both the left and right sides of the window, knows how difficult this can be. Gauging the distances above, to the side of, and within windows and frames of windows routinely has been subject to inaccurate estimation or cumbersome measurement techniques. While rulers, tape measures and right angle squares are used to determine measurements and distances around a window, these tools also are difficult to use for obtaining accurate measurements and attachment points for window treatment hanging supports, especially when dealing with high windows and those difficult to reach.

SUMMARY OF THE INVENTION

It is thus the object of the present invention to overcome the disadvantages and limitations of prior devices and systems used to hang window treatments in proper alignment in relation to a window or window frame.

It is an object of the present invention to provide a window treatment hanging tool which can be used to position any window treatment hanging component for hanging window treatments in proper alignment in relation to a window or window frame.

It is a further object of the present invention to provide a window treatment hanging tool which can be used to properly aligned window treatments above, to the side of, and within a window or window frame by use of a single tool.

It is still a further object of the present invention to provide a window treatment hanging tool which permits wall surfaces on both sides of a window or window frame to be easily and quickly marked at equal distances from each side of a window or window frame.

It is another object of the present invention to provide a window treatment hanging tool which is adaptable, in a plurality of different configurations, to properly align window treatment hanging supports within and directly on window and window frames.

It is a further object of the present invention to provide a window treatment hanging tool which ensures for level and aligned hanging of all window treatments in relation to a window or window frame.

These and other objects are accomplished by the present invention, a window treatment hanging tool made up of two right angled shaped guide components. The first guide component has dual arms positioned perpendicular to each other, each with channeled pathways. The second guide component also has dual arms in perpendicular relation to each other, each arm having an elongated member which is adapted to be slideably and adjustably insertable within the pathways of the first guide component. Each guide component also has measurement markings. Properly positioning the guide components on or within windows or window frames allows proper alignment and lateral equidistance positioning of a window hanging treatment support in relation to the window or window frame.

Novel features which are considered as characteristic of the invention are set forth in particular in the appended claims. The invention, itself, however, both as to its design, construction and use, together with the additional features and advantages thereof, are best understood upon review of the following detailed description with reference to the accompanying drawings.

DETAILED DESCRIPTION OF THE INVENTION

Figure 1:
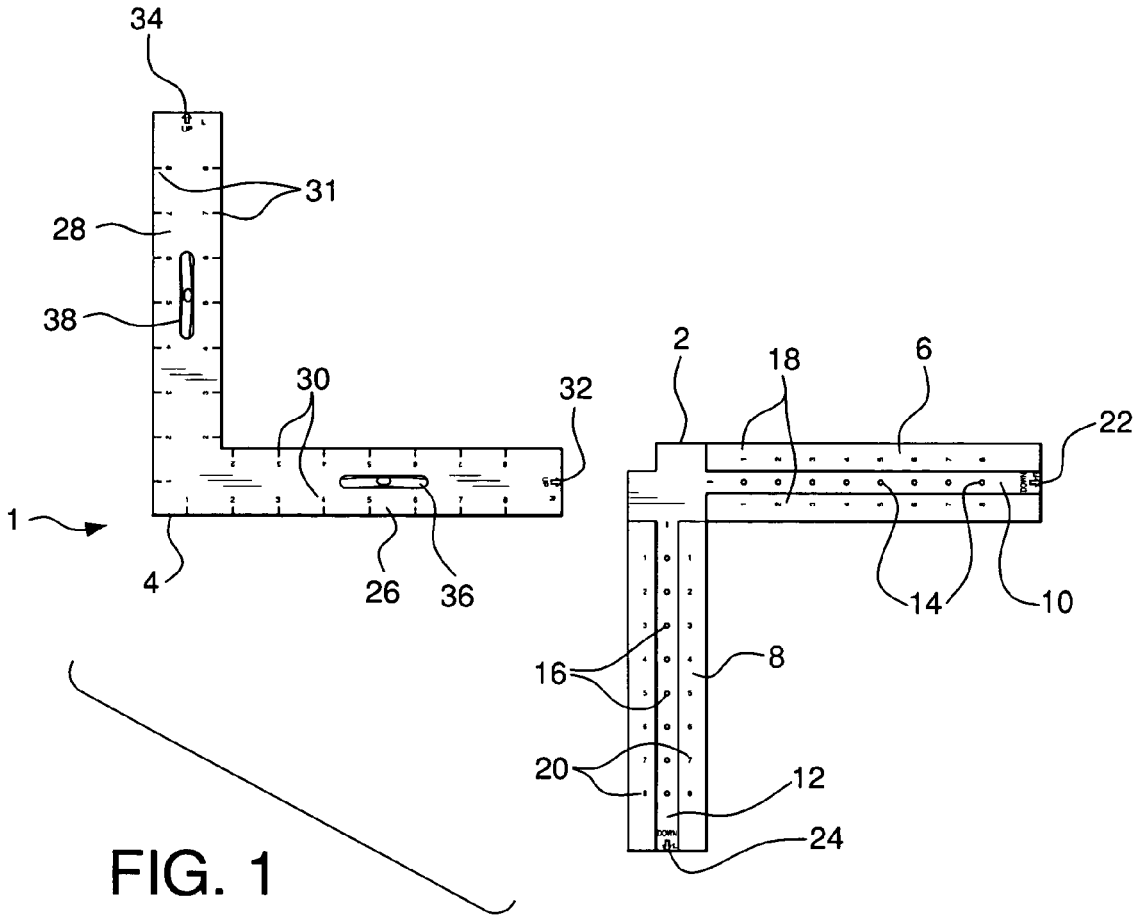
FIG. 1 shows top views of the two guide components of the present invention.
Figure 2:
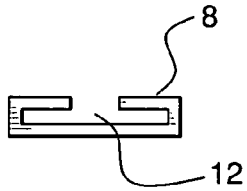
FIG. 2 shows an end view of one arm of the first guide component of the present invention.

Window treatment hanging tool 1 of the present invention comprises first guide component 2 and second guide component 4. First guide component 2 comprises arms 6 and 8, positioned in perpendicular relation to each other, with channeled pathways 10 and 12 respectively. First guide component 2 has multiple guide holes 14 within arm 6 and 16 within arm 8, and measurement markings 18 on arm 6 and 20 on arm 8. Position markings 22 and 24 on arms 6 and 8 respectively assist in the manner of use of this component of the tool, as will be described hereinafter.

Figure 3:
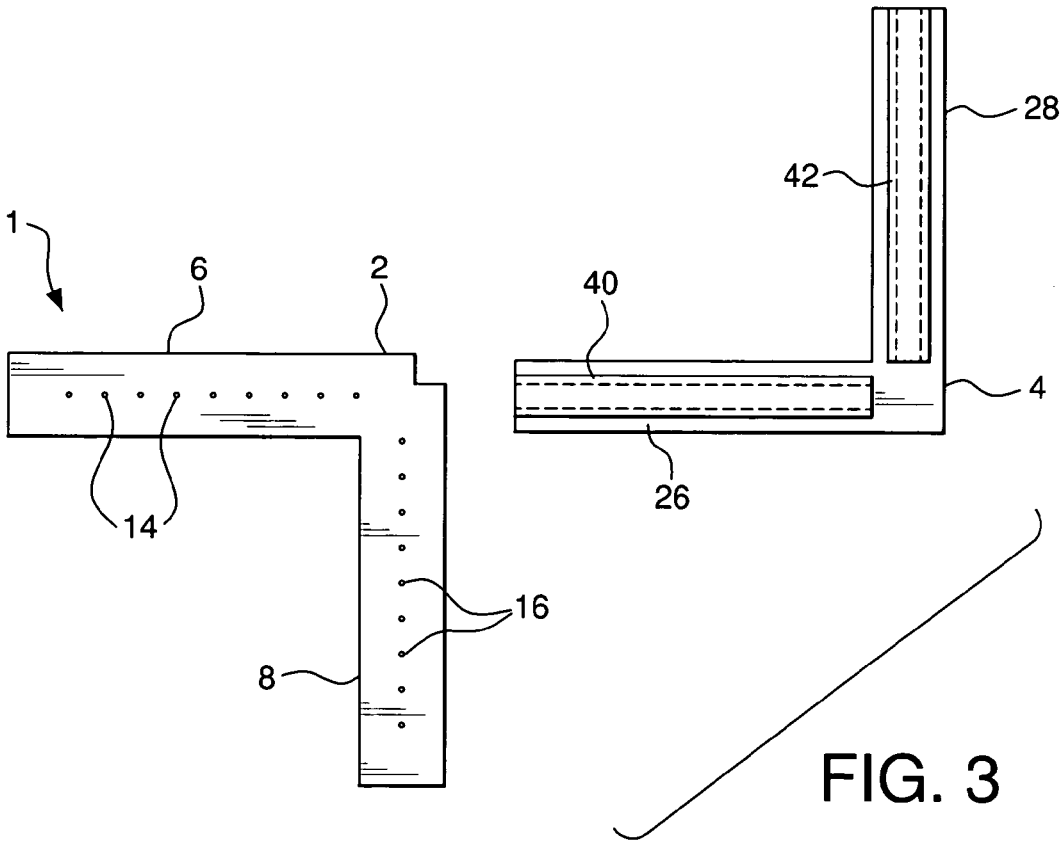
FIG. 3 shows bottom views of the two guide components of the present invention.
Figure 4:
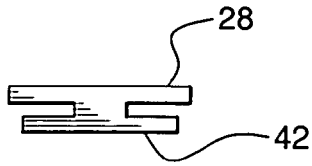
FIG. 4 shows an end view of the second guide component of the present invention.

Second component 4 of tool 1 comprises dual arms 26 and 28 positioned in perpendicular relation to each other. Arm 26 comprises measurement markings 30 and arm 28 comprises measurement markings 31. Position markings 32 on arm 26 and 34 on arm 28 assist in the use of the tool, as described hereinafter. Sight levels 36 and 38 are provided on arms 26 and 28 respectively. As best seen in FIG. 3, arm 26 comprises elongated extension member 40 and arm 28 comprises elongated extension member 42. Members 40 and 42 are adapted to be slideably and adjustably insertable within pathways 10 and 12 of arm 8 of first guide component 2. It is contemplated that pathways 10 and 12 could be configured of different widths and that member 40 would be appropriately sized to be slideably and adjustably insertable into pathway 10 and member 42 would be sized to be similarly moveable within pathway 12. This would facilitate and ensure that the proper member is used in its corresponding pathway.

Figure 5:
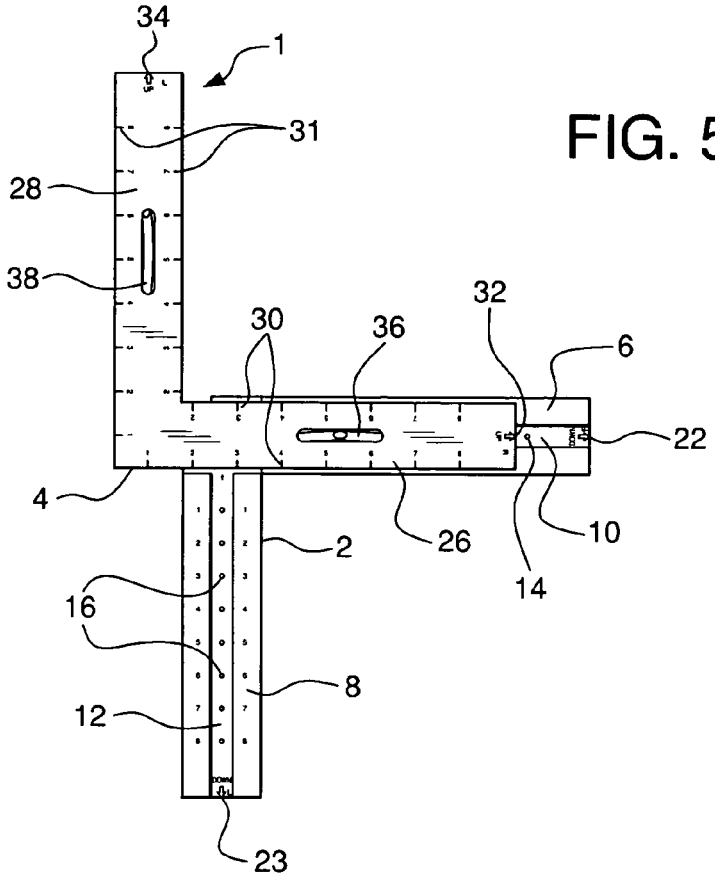
FIG. 5 shows the slideably adjustable connection between the first and second guide components of the present invention, positioned to mark the wall adjacent to the upper lefthand corner of a window.
Figure 7:
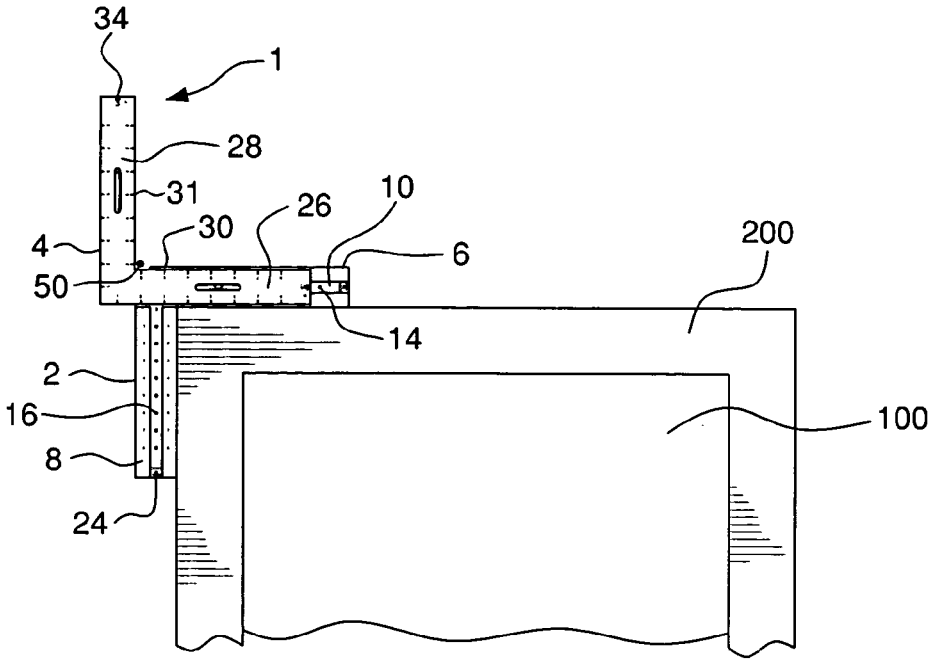
FIG. 7 shows the tool of the present invention in use to mark the wall adjacent to the upper lefthand corner of a window.

Tool 1 is used to ensure that window treatment supports, such as curtain and valance rods and brackets, vertical and horizontal Venetian blind supports, and similar supports are properly aligned in relation to windows. By way of example, when attempting to hang a window treatment which employs a curtain rod, tool 1, as shown in FIG. 7, is first positioned on the upper lefthand corner of window frame 200 of window 100. The right angle formed between dual arms 6 and 8 of first guide component 2 is aligned with the upper left square of window frame 200. First guide component 2 is placed such that position marking 24, labeled as "Down-L", is positioned as is shown in FIG. 7. Member 40 of arm 26 of second guide component 4 is slideably inserted into pathway 10 of arm 6 of first guide component 2, as shown in FIG. 5. Position marking 34, labeled "Up-L", designates the proper position of second guide component 4, when marking the wall adjacent to the upper left corner of window 100.

Upon placement of tool 1, as shown in FIG. 7, second guide component 4 can be slideably adjusted within guide component 2 to find the desired location on the wall to attach the curtain rod on the left side of window 100. Measurement markings 30 on arm 26 and 31 on arm 28 pinpoint the exact vertical and horizontal attachment location. Levels 36 and 38 ensure for proper horizontal and vertical alignment. Once the desired distance over and above window 100 is determined, an appropriate mark 50 can be made on the wall surface, designating the exact location where a screw or similar attachment means will be attached to the wall to suspend the left side of the curtain rod.

Figure 6:
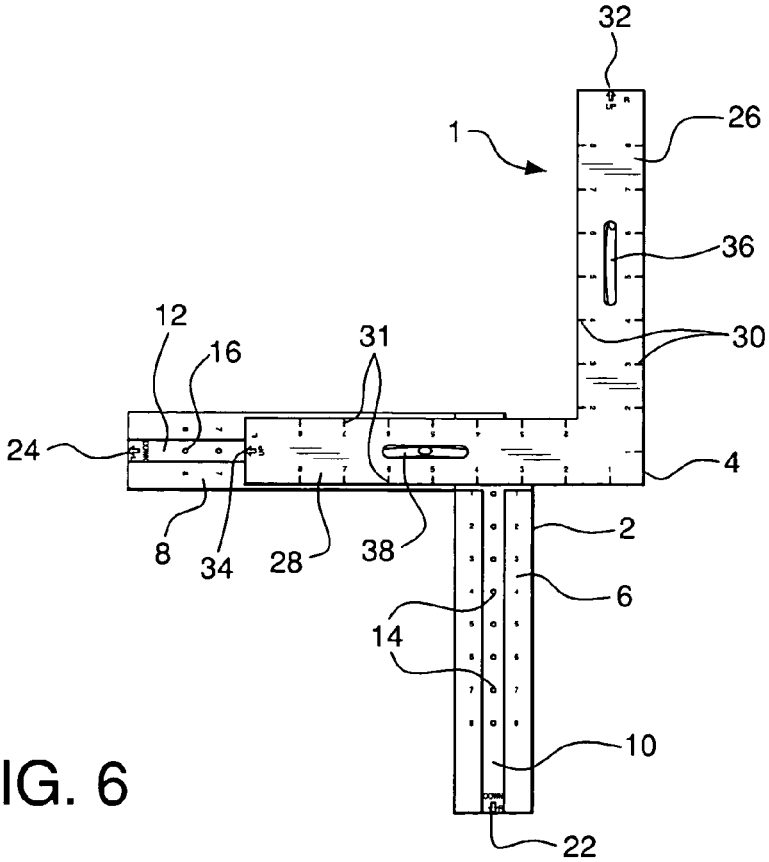
FIG. 6 shows the slideably adjustable connection between the first and second guide components of the present invention, positioned to mark the wall adjacent to the upper righthand corner of a window.
Figure 8:
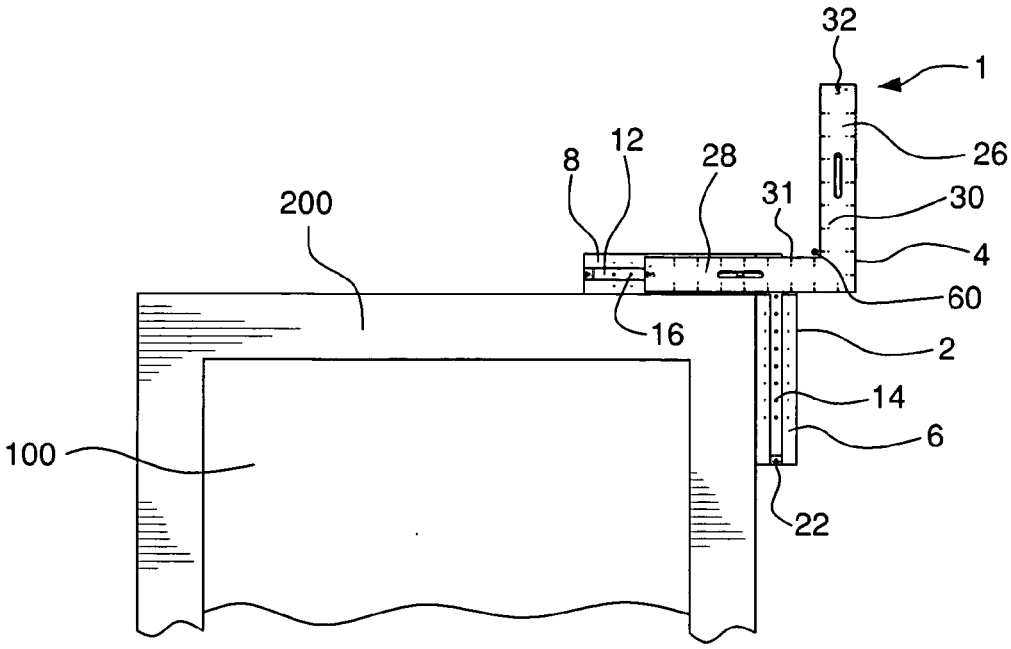
FIG. 8 shows the tool of the present invention in use to mark the wall adjacent to the upper righthand corner of a window.

Tool 1 is then repositioned over the upper righthand corner of window frame 200 of window 100, such that the right angle formed between dual arms 6 and 8 of first guide component 2 is aligned with the upper right square of window frame 200. First guide component 2 is placed such that position marking 22, labeled as "Down-R", is positioned as is shown in FIG. 8. Member 42 of arm 28 of second guide component 4 is slideably inserted into pathway 12 of arm 8 of first guide component 2, as shown in FIG. 6. Position marking 32, labeled "Up-R", designates the proper position of second guide component 4, when marking the wall adjacent to the upper right corner of window 100.

Upon placement of tool 1, as shown in FIG. 8, second guide component 4 can be slideably adjusted within guide component 2 to find the desired location on the wall to attach the curtain rod on the right side of the window 100. Measurement markings 30 on arm 26 and 31 on arm 28 are matched to the measurements previously made to determine the attachment location on the left side of window 100; thereby pinpointing the exact vertical and horizontal attachment location on the right side of the window which aligns with the attachment location on the left side of the window. Levels 36 and 38 once again ensure for proper horizontal and vertical alignment. And, as with the left side of window 100, once the desired distance over and above the window is determined, an appropriate mark 60 can be made on the wall surface, designating the exact location where a screw of similar attachment means will be attached to the wall to suspend the right side of the curtain rod.

It can also readily be seen that, if the attachment location must be measured directly above or to the side of window frame 200, first guide component 2 can simply be placed such that the right angle formed between dual arms 6 and 8 are aligned with the upper left and then upper right square of window frame 200. When curtain rods or other window treatment hanging supports are to be positioned immediately above and to the left of window 100, first guide component 2 is placed on the left corner of window frame 200 and one of the guide holes 14 of arm 6 can be used to make a measured mark on the wall above window frame 200. First guide component 2 can then be turned 90° and placed on the right corner of window frame 200 and a mark can be made on the wall through the measured guide hole 16 of arm 8 which corresponds to guide hole 14 of arm 6 which was used to mark the left corner of the frame.

Similarly, when a curtain rod or other window hanging treatment support is to be attached to the side of window 100, first guide component 2 is again placed with its dual arms 6 and 8 aligned with the upper left and right square of window frame 200 and measured marks can be made through guide holes 16 when guide component 2 is positioned on the left corner and corresponding guide holes 14 when guide component 2 is positioned on the right corner, to ensure that the proper distances are maintained on both sides of window 100, for equidistant alignment to attach the appropriate window treatment support.

Figure 9:
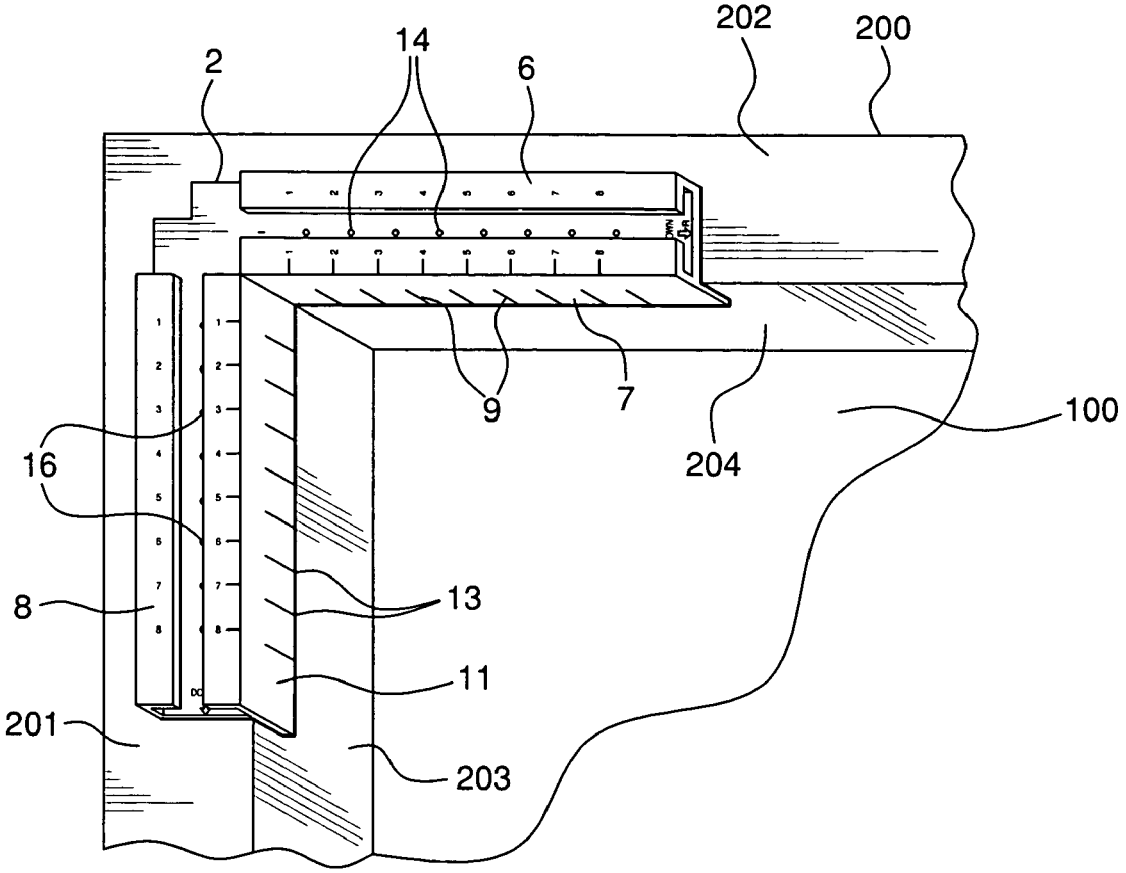
FIG. 9 shows the tool of the present invention in use to mark a window frame.

FIG. 9 shows first guide component 2 of tool 1 used on the interior of window frame 200 of window 100. As can be seen in that figure, there are extended side walls 7 and 11 of arms 6 and 8 respectively. First guide component 2 is placed on the inside corner of window frame 200 such that the component is placed in the square of the upper left side corner of the frame. Arm 8 extends vertically along the front of side surface 201 and side wall 11 of arm 8 extends vertically along inner side 203 of the frame. Arm 6 extends horizontally along front top surface 202 and side wall 7 extends horizontally along inner top 204 of window frame 200. By this configuration, first guide component 2 can be placed within window frame 200 of window 100 and appropriate measured marks can be made on vertical and horizontal front surfaces 201 and 202 of the frame, through guide holes 14 and 16, for connection of window treatment hanging supports directly on these surfaces; or appropriate measurement marks can be made on vertical and horizontal inner surfaces 203 and 204 of window frame 200 by use of measured markings 9 and 13, for connection of window treatment hanging supports directly on these inner surfaces.

It can be appreciated that after the appropriate measured markings are made on the left side of window frame 200, first guide component 2 is repositioned such that the component is placed in the square of the upper right corner of the frame, such that arm 6 and its side wall 7 extends vertically along the side of the right side of the frame and arm 8 and its side wall 11 extends horizontally along the top of the frame. Measured markings consistent with those made on the left side of frame 200 are then made on the right side of the frame to ensure proper alignment of window treatment hanging supports, in relation to window 100.

Thus, by use of tool 1, virtually any support for hanging window treatments can be properly aligned above, to the side of, and within a window or window frame. Wall surfaces on both sides of the window can be easily and quickly marked and equally distanced from the sides of the window, to ensure properly leveled and aligned hanging of any and all window treatments and treatment systems.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed is:

1. A tool for the alignment of a window treatment in relation to a window, said tool comprising:

a. first alignment means for positioning a window treatment in relation to a window, said first alignment means comprising dual arms positioned in perpendicular relation to each other, each arm having a separate pathway; and b. second alignment means for positioning the window treatment in relation to the window, said second alignment means comprising dual arms in perpendicular relation to each other, the arms being removably and adjustably positioned within the pathways of the first alignment means, whereby multiple positionings of the first alignment means in relation to the window and adjustments of the arms of the second alignment means within the pathways of the first alignment means accomplishes alignment of the window treatment in relation to the window.

2. The tool as in claim 1 wherein the second alignment means is insertable into the first alignment means.

3. The tool as in claim 2 wherein the second alignment means is slideably adjustable within the first alignment means.

4. The tool as in claim 1 wherein the second alignment means is slideably adjustable within the first alignment means.

5. The tool as in claim 1 wherein the first alignment means and the second alignment means both comprise measurement markings, the measurement markings of the first alignment means corresponding to the measurement markings of the second alignment means.

6. The tool as in claim 1 wherein the first alignment means comprises guide holes.

7. The tool as in claim 1 wherein the second alignment means comprises level means to measure the horizontal and vertical alignment of the tool.

8. A tool for the alignment of a window treatment in relation to a window, said tool comprising a first guide component and a second guide component comprising dual arms, said second guide component being removably and adjustably positioned within the first guide component, said first guide component having dual path means for the removable positioning and adjustment of the second guide component in two directions within the first guide component, whereby multiple positionings of the first guide component in relation to a window and adjustments of the second guide component within each of the dual path means accomplishes alignment of the window treatment in relation to the window.

9. The tool as in claim 8 wherein the second guide component is insertable into the first guide component.

10. The tool as in claim 9 wherein the second guide component is slideably adjustable within the first guide component.

11. The tool as in claim 8 wherein the second guide component is slideably adjustable within the first guide component.

12. The tool as in claim 8 wherein the first guide component and the second guide component both comprise measurement markings, the measurement markings of the first guide component corresponding to the measurement markings of the second guide component.

13. The tool as in claim 8 wherein the first guide component comprises guide holes.

14. The tool as in claim 8 wherein the second guide component comprises level means to measure the horizontal and vertical alignment of the tool.

15. The tool as in claim 8 wherein the first guide component comprises dual arms which comprise the dual path means.

16. The tool as in claim 15 wherein the dual arms of the first guide component are positioned in perpendicular relation to each other.

17. The tool as in claim 8 wherein the dual arms are positioned in perpendicular relation to each other.

18. The tool as in claim 17 wherein the first guide component comprises dual arms which comprise the dual path means.

19. The tool as in claim 18 wherein the dual arms of the first guide component are positioned in perpendicular relation to each other.

20. A tool for the alignment of a window treatment in relation to a window, said tool comprising:

a first guide component configured to be positioned adjacent to a window and a second guide component comprising dual arms, said second guide component being removably and adjustably positioned within the first guide component, said first guide component having multiple path means for the insertion and adjustable positioning of the second guide component within the first guide component to determine multiple locations of a window treatment in relation to the window.

21. The tool as in claim 20 wherein the second guide component is insertable in multiple directions into the path means of the first guide component.

22. The tool as in claim 21 wherein the second guide component is slideably adjustable in multiple directions within the path means of the first guide component.

23. The tool as in claim 20 wherein the second guide component is slideably adjustable in multiple directions within the path means of the first guide component.

24. The tool as in claim 20 wherein the first guide component and the second guide component both comprise measurement markings, the measurement markings of the first guide component corresponding to the measurement markings of the second guide component.

25. The tool as in claim 20 wherein the first guide component comprises guide holes.

26. The tool as in claim 20 wherein the second guide component comprises level means to measure the horizontal and vertical alignment of the tool.

27. The tool as in claim 20 wherein the first guide component comprises dual arms which comprise the path means.

28. The tool as in claim 27 wherein the dual arms of the first guide means are positioned in perpendicular relation to each other.

29. The tool as in claim 20 wherein the dual arms are positioned in perpendicular relation to each other.

30. The tool as in claim 29 wherein the first guide component comprises dual arms which comprise the path means.

31. The tool as in claim 30 wherein the dual arms of the first guide component are positioned in perpendicular relation to each other.

* * * * *